United States Patent [19]

Boussemart et al.

[11] Patent Number: 4,951,961

[45] Date of Patent: Aug. 28, 1990

[54] DEVICE FOR SUPPORTING THE SOLE OF A BOOT ON A SKI

[75] Inventors: Jean-Pierre Boussemart, Choisy; Jean-Philippe Gorliez, Aix Les Bains, both of France

[73] Assignee: Salomon, S.A., Cedex, France

[21] Appl. No.: 242,863

[22] Filed: Sep. 12, 1988

[30] Foreign Application Priority Data

Sep. 18, 1987 [FR] France ..... 87 12952

[51] Int. Cl.[5] ..... A63C 11/00

[52] U.S. Cl. ..... 280/636

[58] Field of Search ..... 280/636, 618, 620

[56] References Cited

U.S. PATENT DOCUMENTS

| | | | |
|---|---|---|---|
| 3,448,990 | 6/1969 | Cubberley et al. | 280/636 |
| 3,511,516 | 5/1970 | Smolka et al. | 280/620 X |
| 3,743,310 | 7/1973 | Smolka | 280/636 |
| 3,819,200 | 6/1974 | Schweizer et al. | 280/636 |
| 3,845,965 | 11/1974 | Lipe | 280/636 |
| 3,927,895 | 12/1975 | Spier et al. | 280/636 |
| 4,088,345 | 5/1978 | Korger | 280/636 |
| 4,226,439 | 10/1980 | Kirsch | 280/628 |

FOREIGN PATENT DOCUMENTS

| | | | |
|---|---|---|---|
| 1578818 | 12/1970 | Fed. Rep. of Germany | 280/636 |
| 2553169 | 6/1977 | Fed. Rep. of Germany . | |
| 2105872 | 4/1972 | France . | |
| 2152646 | 4/1973 | France . | |

*Primary Examiner*—Charles A. Marmor
*Assistant Examiner*—Brian L. Johnson
*Attorney, Agent, or Firm*—Sandler, Greenblum & Bernstein

[57] ABSTRACT

A support apparatus for the sole of a ski boot upon the upper surface of the ski, mountable on the ski in a zone where a portion of the sole is positioned to be displaced laterally during release of the boot from a safety binding. The support apparatus includes at least two support elements each of which includes an endless band which is displaceable rotationally with respect to a guide plate. The support elements, i.e., the endless bands, are to be positioned substantially end-to-end transversely of the ski. Each of the endless bands is to be movable in a direction substantially perpendicular to a radius of curvature from a point on the ski corresponding to a point of the sole of the ski boot about which the boot pivots during lateral release of the boot from the ski binding. At least two of the support elements are positioned on either side of the longitudinal axis of the ski and are positioned substantially symmetrically with respect to the longitudinal axis. Each of the endless bands of the support apparatus are located within respective openings of a common support member such that a convex exterior surface of the respective endless bands projects beyond the upper surface of the support member for engagement with the sole of the boot.

15 Claims, 1 Drawing Sheet

DEVICE FOR SUPPORTING THE SOLE OF A BOOT ON A SKI

BACKGROUND OF THE INVENTION

1. Field of Invention

The present invention relates to a device for supporting the sole of a boot on a ski in a zone thereon where a portion of the sole is displaced laterally during release of the boot from a safety binding which maintains the boot on the ski.

2. Description of Background and Relevant Information

Various support apparatus for the sole of a boot on a ski are known which are adapted to facilitate the lateral sliding of the sole during release of the boot from the safety binding. Certain of these known apparatus utilize juxtaposed rollers and this is the case of the system described in French Pat. No. 2,152,646. Such a juxtaposed roller support device has, however, the disadvantage of scoring the length of the sole of the boot, which affects the lateral release movement of the boot from the binding. Furthermore, if the sole of the boot is made out of a relatively soft material, the rollers tend to penetrate into the thickness of the sole, which likewise causes a hindrance to the lateral displacement of the boot.

Other known support apparatus include an endless band extending around a support which is affixed to the ski. The principal advantage of such apparatus is that, when the sole of the boot is displaced laterally towards the exterior, during the release of the safety binding, it moves with the endless band, without sliding with respect thereto, the endless band being itself rotated around its support. As a result, the sliding which normally occurs between the sole of the boot and the ski is transferred between the upper portion of the endless band and the upper surface of its support on which it slides. This is particularly advantageous in the case of boots whose soles have non-skid zones, and particularly walking boots. Such support apparatus are described, for example, in French Pat. No. 2,105,872, French Pat. No. 2,152,646 and U.S. Pat. No. 3,845,965. The support apparatus described in these patents all comprise a single endless transverse band which extends substantially over the entire width of the ski. Yet, such a support apparatus has a substantial disadvantage resulting from the great length of the endless band on which the sole of the boot rests. In effect, the band is very vulnerable to kicks and to longitudinal movements of the boot which tend to cause the band to become disengaged from its support. Such longitudinal movements occur in particular during insertion of the boot, with the closure of the jaw of the rear binding.

SUMMARY OF THE INVENTION

Accordingly, it is an object of the present invention to provide a support apparatus for supporting the sole of a ski boot upon a ski adjacent a binding for an end of the ski boot which is not characterized by the disadvantages mentioned above. According to the present invention, the support apparatus inclues a plurality of support elements, with each of the support elements including an endless band and a guiding device for guiding the endless band for movement in a predetermined direction for facilitating release of the boot from the binding.

It is an object of the invention to arrange the endless bands of the support elements in an end-to-end manner across the width of the ski. Preferably, the endless bands are arranged to move along respective longitudinal axes that form obtuse angles which are open rearwardly of the ski. That is, the longitudinal bands are designed to move in either opposite direction transversely to the longitudinal axis of the ski.

In one aspect of the invention the support apparatus is adapted to be mounted upon the ski in a zone corresponding to lateral release movement of the boot from the binding. Each of the endless bands is designed to move in a direction which is substantially perpendicular to a radius of curvature from a point on the ski corresponding to a point of the sole of the ski boot about which the boot pivots during lateral release of the boot from the ski binding. In another words, the individual support elements are positioned rearwardly of a front binding and are oriented tangentially of a circle whose center is positioned substantially at the point of the ski corresponding to the center of the heel of the foot within the ski boot.

In another aspect of the invention, the endless bands of the support elements can be mounted forwardly of a rear binding and oriented to accommodate pivoting of the boot about a point corresponding to the ball of the foot. Alternatively, the support elements could be mounted in positions adjacent both the front and rear bindings, respectively, to accommodate transverse movement of the boot relative to the ski.

In another aspect of the present invention, the individual support elements are to be mounted on a common support member which is adapted to be fixed to the ski.

In a still further aspect of the present invention, the endless bands of each of the plurality of support elements includes a guide plate around which the respective endless bands are retainable.

In a still further aspect of the present invention, each of the endless bands are mounted for rotation around a respective guide plate and the guide plates are located in respective openings in the support member such that the exterior surfaces of the respective endless bands project beyond the upper surface of the support member for engagement with the sole of the ski boot.

In a still further aspect of the present invention, the openings of the support member include interior surfaces having seating openings therein whereby the guide plate includes longitudinal edge portions for engagement within the seating openings.

In a still further aspect of the present invention, the respective guide plates include a projection which extends from the guide plate around the periphery of the guide plate for guiding a complementary shaped interior recess of the respective endless bands. Preferably, the projection of each guide plate includes rounded longitudinal edges which engage the complementary shaped recesses within the respective endless bands.

In a still further aspect of the present invention, each endless band has a relatively thickened external surface having a convex cross-section with a relatively large radius of curvature. The central portion of the respective endless bands extend through a substantially rectangular opening formed in the upper surface of the support member such that the external surface of the respective endless bands project slightly above the upper surface of the support member. In a still further aspect of the present invention, each of the endless bands include longitudinally extending lips which slidingly engage within further openings within the interior surfaces of the openings of the support member.

In a still further aspect of the present invention, each of the guide plates is maintained within the support member by a means of a removable element which is engageable within a respective one of the openings in the support member and which partially defines a seat for receiving one of the edges of the guide plate.

In a still further aspect of the present invention, the plurality of individual support elements are positioned on either side of a longitudinal axis of the ski and substantially symmetrically with respect to the longitudinal axis.

In a still further aspect of the present invention, the plurality of individual support elements can include three such elements, at least one of which is positioned transversely and symmetrically with respect to the longitudinal axis of the ski. The longitudinal axes of the three individual support elements and an imaginary straight line connecting rearward portions of the outer support elements form substantially as isosceles trapezoid.

BRIEF DESCRIPTION OF THE DRAWINGS

The invention will now be described with reference to certain non-limiting embodiments thereof, with reference to the accompanying drawings in which.

DESCRIPTION OF PREFERRED EMBODIMENTS

The present invention attempts to overcome the disadvantages of prior art devices by providing a support apparatus of the endless band type having a particularly simple design and one which is much less sensitive to the longitudinal action of the boot.

To this end, the support device for the sole of a boot on a ski, which device is mounted on a ski in a zone where a portion of the sole is laterally displaceable during release of a safety binding which maintains the boot on the ski, is characterized in that it includes at least two individual support elements which are each of the endless band type. Each endless band extends around and is rotationally displaced around a support affixed to the ski, the two endless bands of the two individual support elements being positioned on either side of the longitudinal axis of the ski and substantially symmetrically with respect to this axis.

Figure 1:
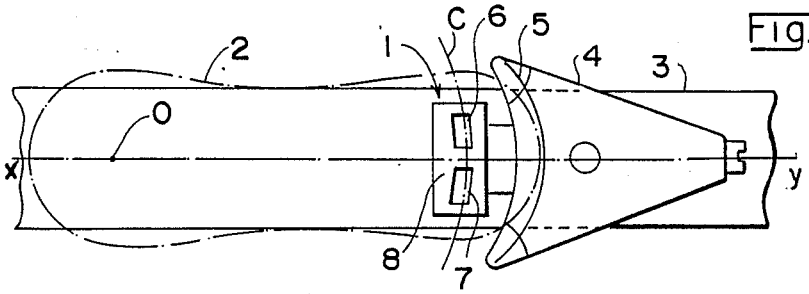
FIG. 1 is a plan view of a support apparatus for the sole of a boot on a ski according to the invention.

The support apparatus according to the invention, which is indicated in its entirety by reference numeral 1 in FIG. 1, is adapted to support a portion of the sole of a boot 2, as indicated by phantom lines in FIG. 1, on a ski 3. This boot is maintained in the normal manner by a safety binding 4 which is constituted, in this case, by a front abutment whose jaw 5 retains the front of the sole of boot 2.

According to the invention, the support apparatus 1 includes two individual support elements 6 and 7 which are each of the endless band type and which can be rotationally displaced around a support. These two individual support elements 6 and 7 are mounted on a common support member 8, which is itself affixed to the ski, and elements 6 and 7 are positioned on both sides and are substantially symmetrical with respect to the longitudinal axis x-y of the ski. They can be aligned transversely or, preferably, they can form a very flat obtuse angle, i.e. close to 180 degrees, open towards the rear. In the case where, as is shown in FIG. 1, the two individual support elements 6 and 7 are positioned at the rear of a front abutment 4, they are preferably oriented along tangents to a circle C whose center 0 is positioned substantially at the center of the position of the heel of boot 2. This arrangement facilitates the lateral displacement of the front of the boot 2, by rotation around the center 0, during release from front abutment 4.

Figure 2:
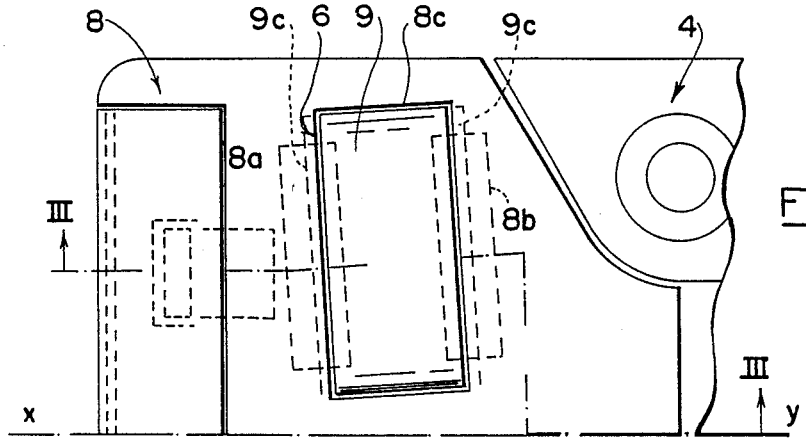
FIG. 2 is a half plan view on a magnified scale, of the support apparatus of FIG. 1.
Figure 3:
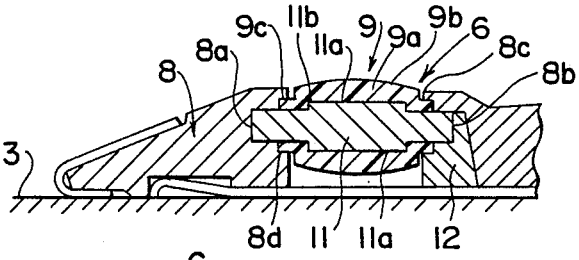
FIG. 3 is a cross-sectional view along line III—III of FIG. 2.

With reference to FIGS. 2 and 3, it can be seen that the individual support element 6, which is shown therein on a larger scale, includes an endless band 9 which extends around and which is rotationally displaceable and guided around a support or guide plate 11 whose width is, preferably, at most equal to approximately half the width of the ski. Support 11 is constituted by a horizontal, relatively small plate having a substantially rectangular shape and elongated transversely, whose front and rear edges are engaged and maintained in respective seats **8*a* and 8*b* of support plate 8**.

In its central portion, support plate 11 has a projection **11*a* extending all around its periphery, has a substantially rectangular shape, and is engaged in a central hollow portion, substantially complementary in shape, provided in the internal surface of portion 9*a* of endless band 9. Projection 11*a* thus assures the guidance of the endless band 9 during its rotation around plate 11. The longitudinal edges 11*b* of plate 11 can be substantially sharp, but are preferably rounded. The upper surface of the endless band 9 is therefore movable in a predetermined direction substantially perpendicular to a radius of curvature from point 0. The endless band 9 is, of course, free to move back or forth across guide plate 11, depending upon the direction of release of boot 2 from binding 4**.

The central portion **9*a* of band 9 which slides within projection 11*a* of support of small support plate 11 is relatively thick and it presents an external surface 9*b* whose cross-section is preferably convex, having a relatively large radius of curvature. Central portion 9*a* extends in relatively close tolerance through a substantially rectangular opening 8*c* formed in the upper surface of support plate 8, the convex external surface 9*b* of band 9 projecting slightly from the upper surface of support plate 8. Extending from the front and rear of the central portion 9*a* of band 9 are respective lips 9*c* extending towards the exterior of band 9 and which slide in contact with the surface of the support plate 11, and are located on each side of projection 11*a*. Lips 9*c* are tightly engaged in corresponding openings 8*d* provided in support plate 8**, so as to constitute sealing joints.

The attachment of each individual support element in support plate 8 is achieved by means of a removable element 12 which partially defines a seating opening **8*b* receiving an edge (for example the front edge) of the support plate 11. As a result, the assembly of the individual support element 6 can be accomplished very easily as follows: it suffices in effect to engage first, from the bottom, the rear edge of support plate 11 in the internal posterior seating opening 8*a* of support plate 8, then to nest the support element 6 upwardly in support plate 8, in a manner such that band 9 is engaged in the upper opening 8c of plate 8 and projects slightly above, after which individual support element 6 is fixed in an engaging position and the removable element 12 is fixed in the space provided for this purpose in the lower portion of support plate 8, to provide the seat 8b and to assure the maintenance of the front edge of the support plate 11**.

Figure 4:
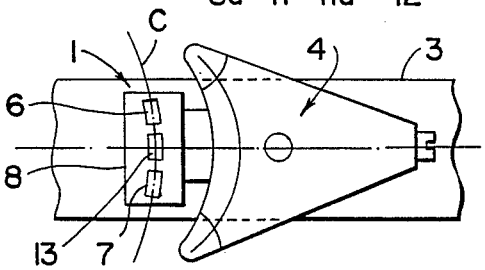
FIG. 4 is a plan view of an alternative embodiment of the support apparatus according to the invention.

In the embodiment of the invention shown in FIG. 4 the support apparatus 1 includes three individual support elements, in addition to the lateral support elements 6 and 7, namely a third central support element 13 positioned between them and extending transversely. Here again the three individual support elements 6, 7, 13 whose longitudinal axes and an imaginary straight line (not shown) connecting rearward portions of the outer support elements 6 and 7 form an isosceles trapezoid, are preferably oriented substantially along tangents to the circle C.

Finally, although the invention has been described with reference to particular means, materials and embodiments, it is to be understood that the invention is not limited to particulars disclosed and extends to all equivalents within the scope of the claims.

What is claimed is:

1. Support apparatus for the sole of a ski boot upon the surface of a ski mountable on the ski in a zone where a portion of the sole is positioned to be displaced laterally during release of the boot from a safety binding maintaining the boot on the ski, wherein said support apparatus comprises at least two individual support elements wherein each comprises an endless band rotationally displaceable, the respective endless bands of said at least two individual support elements being positioned on either side of a longitudinal axis of the ski and substantially symmetrical with respect to said axis, said individual support elements being mounted on a common support member which is adapted to be fixed to the ski, wherein each endless band is rotationally displaceable around a support member comprising a substantially horizontal guide plate of a substantially rectangular shape and transversely elongated relative to the ski longitudinal axis, and includes front and rear edges which are engaged and maintained in respective corresponding seatings of said support member, wherein each respective guide plate presents, in a central portion, a projection extending around said guide plate, having a substantially rectangular planar shape, which engages in a central hollow portion, of a complementary shape, provided in an internal surface of a central portion of a respective endless band, said projection thereby assuring guidance of the endless band during rotational displacement around said guide plate, wherein said central portion of said band which slides on said projection of said guide plate is relatively thick and has an external surface of a convex cross-section, having a large radius of curvature, said central portion extending through a substantially rectangular opening formed in an upper surface of said support member, said external surface of said endless band projecting slightly with respect to said upper surface of said support member, said central portion of said band extending exteriorly into a lip on each of a front and rear side and which slides in contact with an outer surface of said guide plate on each side of said projection, each lip being engaged tightly in corresponding openings provided in said support member, so as to comprise sealing joints.

2. The support apparatus according to claim 1 wherein said individual support elements form a substantially flat obtuse angle, which is close to 180 degrees, and open towards the rear edge.

3. The support apparatus according to claim 2 further comprising a third central support element positioned between said two support elements, said three support elements forming substantially an isosceles trapezoid.

4. The support apparatus according to claim 2 wherein said individual support elements are positioned rearward of a front abutment, and are oriented along tangents to a circle C whose center is positioned substantially at a point of the ski corresponding to the center of the heel of the boot.

5. The support apparatus according to claim 1 wherein a mounting of each individual support element on said support member comprises a removable element means which partially defines said seating receiving an edge of said guide plate.

6. Support apparatus for supporting a portion of a ski boot upon a ski adjacent a binding, said support apparatus comprising a plurality of support elements, each of said support elements comprising an endless band, means for guiding said endless band for movement in a predetermined direction for facilitating release of the boot from the binding, a support member having an upper surface and respective openings therein for receiving each of said plurality of support elements, wherein said means for guiding said endless band of each of said plurality of support elements is mounted within a respective opening of said support member, and wherein said endless band of each of said plurality of support elements comprises an exterior surface having at least a portion projecting beyond said upper surface of said support member for engagement with the sole of a ski boot, said openings in said support member comprising interior surfaces including seating openings, wherein said means for guiding comprises laterally spaced, longitudinally extending edge portions for engagement within said seating openings, and said endless band comprising lips along laterally spaced longitudinally extending edges, and wherein said interior surfaces of said support member comprises further openings for sealingly and slidingly engaging said lips.

7. The support apparatus of claim 6 wherein said means for guiding said endless band of each of said plurality of support elements comprises a guide plate around which said endless band is rotatable.

8. The support apparatus of claim 6 wherein said exterior surface is convex.

9. The support apparatus of claim 6 wherein said ski has a longitudinal axis and said predetermined direction of movement of each of said endless bands is transverse to said longitudinal axis.

10. The support apparatus of claim 9 adapted to be mounted upon the ski in a zone corresponding to lateral release movement of the boot from a ski binding.

11. The support apparatus of claim 10 wherein said direction of movement of each of said endless bands is substantially perpendicular to a radius of curvature from a point on the ski corresponding to a point of the sole of the ski boot about which the boot pivots during lateral release of the boot from the ski binding.

12. The support apparatus of claim 7 wherein said guide plate comprises a projection extending around said periphery, and wherein said endless band comprises an interior groove complementary to said projection for guiding said endless band along said projection.

13. The support apparatus of claim 6 wherein at least one seating opening of said support member comprises a removable element engageable within a respective one of said openings in said support member for removably retaining said guide plate within said support member.

14. The support apparatus of claim 6 wherein said plurality of support elements are arranged substantially end-to-end across the width of the ski.

15. The support apparatus of claim 6 wherein adjacent endless bands of said support elements move along respective longitudinal axes that form an obtuse angle which is open rearwardly of the ski.

* * * * *